US008247976B2

(12) United States Patent
Chuang

(10) Patent No.: US 8,247,976 B2
(45) Date of Patent: Aug. 21, 2012

(54) LED LAMP SET AND LIGHTING BULB OF THE SAME

(76) Inventor: Sheng-Yi Chuang, Hsinchu (TW)

( * ) Notice: Subject to any disclaimer, the term of this patent is extended or adjusted under 35 U.S.C. 154(b) by 354 days.

(21) Appl. No.: 12/763,610

(22) Filed: Apr. 20, 2010

(65) Prior Publication Data

US 2011/0156583 A1 Jun. 30, 2011

(30) Foreign Application Priority Data

Dec. 30, 2009 (TW) ..... 98224686 U

(51) Int. Cl.
*H05B 37/00* (2006.01)
*F21V 21/00* (2006.01)

(52) U.S. Cl. ..... 315/51; 315/185 R; 362/249.02; 313/25

(58) Field of Classification Search ..... 315/32, 315/51, 63, 192, 294, 324; 362/249.02; 313/25, 313/33
See application file for complete search history.

(56) References Cited

U.S. PATENT DOCUMENTS 6,580,228 B1 * 6/2003 Chen et al. ..... 315/185 R
7,883,242 B2 * 2/2011 Ng et al. ..... 362/249.06
8,079,735 B1 * 12/2011 Vakil et al. ..... 362/294
8,157,416 B2 * 4/2012 Lodhie ..... 362/249.02
2010/0084984 A1 * 4/2010 Leon Rovira et al. ..... 315/210
2011/0163681 A1 * 7/2011 Dau et al. ..... 315/191
2011/0298371 A1 * 12/2011 Brandes et al. ..... 315/32
2012/0126699 A1 * 5/2012 Zittel ..... 315/86

FOREIGN PATENT DOCUMENTS

TW M264797 5/2005

* cited by examiner

*Primary Examiner* — Don Le
(74) *Attorney, Agent, or Firm* — Muncy, Geissler, Olds & Lowe, PLLC

(57) ABSTRACT

An LED lamp set and a lighting bulb used thereon are provided. The LED lamp set comprises a plurality of circuit boards, a support post, an ignition circuit and two conducting wires. The circuit boards are spaced from each other in a parallel manner and mounted on the support post in series. Each of the circuit boards is connected to a plurality of LEDs surrounding the support post. The LEDs have a plurality of light emission surfaces tilted outwards. The ignition circuit receives an input power and transforms the input power to an ignition power. The two conducting wires have one end connected to the ignition circuit and linked to the circuit boards in series to ignite the LEDs. The LED lamp set further is coupled with a socket and a lamp shade to form a profile of a lighting bulb compatible to the socket of the ordinary lighting bulbs.

14 Claims, 4 Drawing Sheets

LED LAMP SET AND LIGHTING BULB OF THE SAME

FIELD OF THE INVENTION

The present invention relates to an LED (light emitting diode) lamp set and a lighting bulb of the same and particularly to an LED lamp set that has a novel lamp set arrangement and coupling structure and a lighting bulb used on the lamp set.

BACKGROUND OF THE INVENTION

LED provides higher energy utilization efficiency and longer life span, and an LED lamp set generates higher brightness on the same amount of electric power, thus is widely adopted on various types of applications to replace the conventional lighting bulbs, such as flashlights, traffic lights, vehicle lighting fixtures and the like. It also is gradually being adopted as a lighting source in general households and formed in a profile like the ordinary lighting bulb but with LEDs as the lighting source. For instance, R.O.C. patent No. M264797 entitled "Lighting bulb equipped with LEDs" provides a plurality of plates (circuit boards) surrounded like a post. Each plate has at least one LED. A lamp head is provided to connect to electric power and hold a control circuit which is electrically connected to the plates to drive the LEDs to emit light. The outer end of the lamp head further is fastened to a lamp shade encasing the plates and LEDs to be formed in a profile like an ordinary lighting bulb. The surrounded plates form a polygon. The LEDs are located on the plates to emit light in a radial manner. Due to the light generated by the LED is directional rather than in all directions like the incandescent lamp or fluorescent lamp, the area where the LED is not directly illuminating has a significant brightness difference. If the LEDs are not arranged densely, light beams are spaced from each other notably. Such a phenomenon seriously affects its acceptance to the general users.

Many techniques have been proposed in prior arts or developed to improve light beam density of lighting bulbs by deploying more LEDs. Such an approach increases the cost and power consumption, and waste heat also is increased during lighting. Moreover, increase of waste heat affects the life span and stability of the lighting bulb. In addition, the junction of two neighboring plates cannot hold the LEDs, hence a notable dark area is formed between the two plates. Furthermore, the plates used by aforesaid conventional technique are formed in a preset specification to couple the LEDs. In the event that customers request different specifications (such as different watts or sizes), the design of the plates has to be changed to meet the new requirements. As a result, design and production costs are increased.

Hence the conventional techniques still leave a lot to be desired, especially on lighting effect and production, and the problem of uneven light beams cannot be solved by merely increasing the density of the LEDs. Providing an improved structure still is needed.

SUMMARY OF THE INVENTION

In view of the disadvantages of the aforesaid conventional technique, the primary object of the present invention is to provide an improved lighting bulb structure and arrangement to solve the problem of notably spaced light beams.

The present invention provides an LED lamp set and a lighting bulb thereof. The LED lamp set comprises a plurality of circuit boards, at least one support post, an ignition circuit and at least two conducting wires. The circuit boards are spaced from each other in a substantially parallel manner and mounted on the support post in series. Each circuit board is connected to a plurality of LEDs surrounding the support post. The LEDs have a plurality of light emission surfaces formed a non-vertical inclined angle with the surface of the circuit board. The ignition circuit receives an input power and transforms the input power to an ignition power. The two conducting wires have one end connected to the ignition circuit and linked to the circuit boards in series to ignite the LEDs. As the light emission surfaces of the LEDs and the circuit board surround the support post at an inclined angle, light illuminates in an inclined manner fully outwards at 360 degrees. Moreover, as LED lamp set is formed by coupling the circuit boards in series, the LEDs are distributed more evenly. Thus the problem of notable space between the light beams during lighting that happens to the conventional technique can be improved. The LED lamp set further can be coupled with a socket and a lamp shade. The socket has a plurality of conducting rims to conduct the input power to the LED lamp set. The lamp shade and socket are coupled to cover the LED lamp set, and a holder formed by injection is provided to steadily hold the support post in the socket to form a profile of a lighting bulb which can be directly coupled on the general lamp socket. As a result, the present invention can overcome the conventional problem of uneven light emission and is adaptable to the commonly used lamp socket to make promotion for general household use easier.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
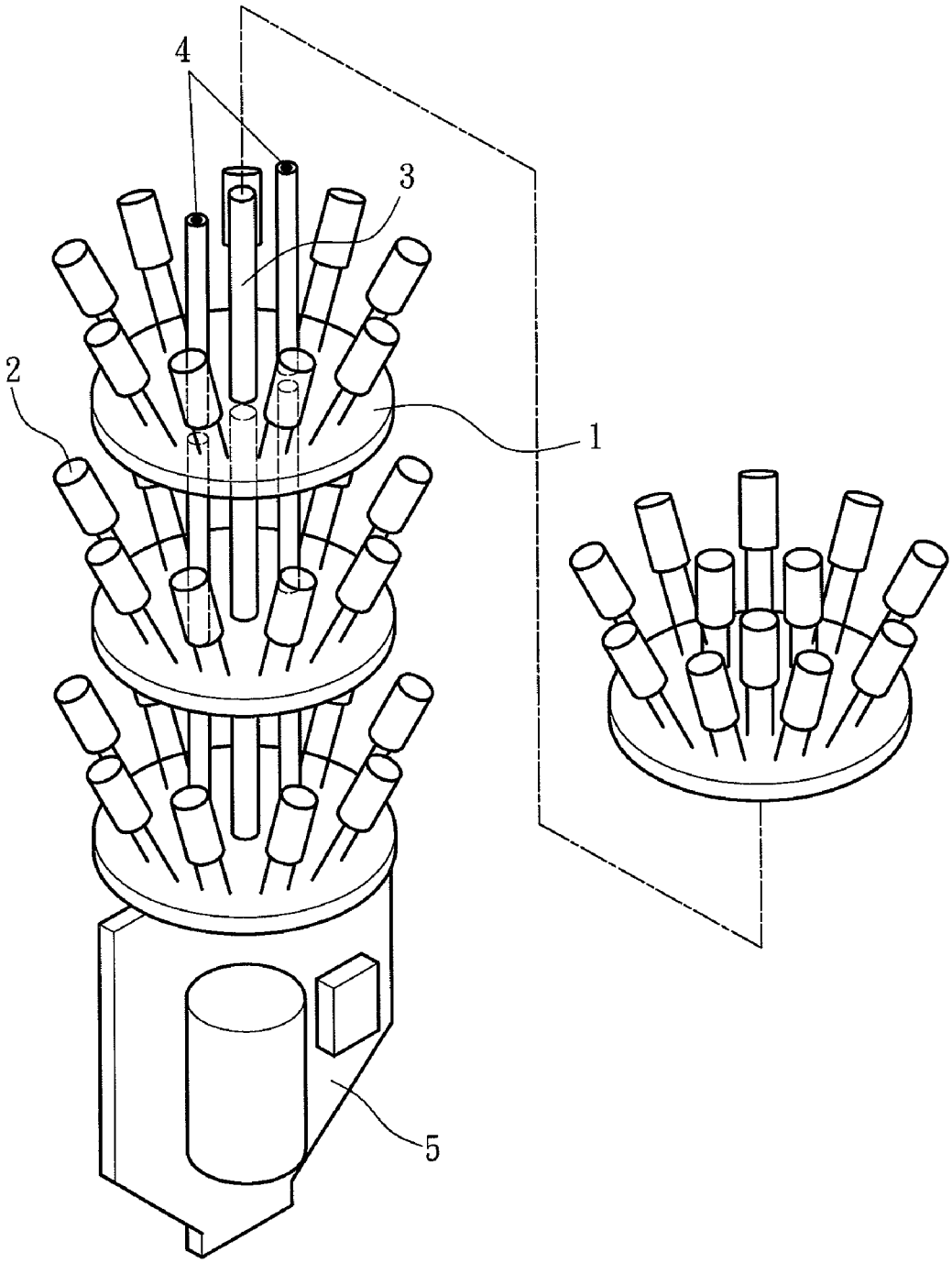
FIG. 1 is a schematic view of the structure of the LED lamp set of the present invention.

The present invention aims to provide an LED lamp set and a lighting bulb thereof. Please refer to FIG. 1, the LED lamp set comprises a plurality of circuit boards 1, at least one support post 3, an ignition circuit 5 and at least two conducting wires 4. The circuit boards 1 are spaced from each other in a substantially parallel manner and mounted on the support post 3 in series. In a preferred embodiment, the support post 3 runs through all the circuit boards 1 to provide excellent support. Each of the circuit boards 1 is connected to a plurality of LEDs 2. The LEDs 2 have a plurality of light emission surfaces formed in a non-vertical inclined angle with the surface of the circuit board 1. More specifically, the LEDs 2 surround the support post 3 and are tilted away from the center of the circuit boards 1 to emit light outwards with full directions at 360 degrees.

One of the circuit boards 1 is located at the distal end of the support post 3 and has at least one LED 2 located between the LEDs 2 surrounded on the circumference of the circuit board 1, the LED 2 also can be located at the center of the topmost circuit board 1 to increase light beam density. The ignition circuit 5 receives an input power and transforms the input power to an ignition power. The two conducting wires 4 are linked to the circuit boards 1 in series and have one end connected to the ignition circuit 5 to conduct the ignition power to ignite the LEDs 2 through the circuit boards 1. By means of the structure set forth above, the LEDs 2 are surrounded on each circuit board 1 to emit light beams outwards. The LEDs 2 are arranged more evenly on the circuit boards 1 that are coupled in series to form the LED lamp set, and the emitted light can illuminate outwards with full directions at 360 degrees. This is the first advantage of the present invention. Moreover, since the LEDs 2 are surrounded on the circumference of the circuit boards 1 and tilted outwards, compared with the conventional vertical layout, the light emission surfaces of the LEDs 2 are more dispersed, and heat generated by the LEDs 2 also is distributed more evenly so that the temperature of the LED lamp set is lower and rises slower when in use, this is the second advantage of the present invention. In addition, the present invention can be made modularly according to customer's requirements to make production and assembly easier. This is the third advantage of the present invention. The number of the circuit boards 1 mounted on the support post 3 can be customized and determined according to customer's requirements. The watt specification required by customers can be set by increasing or decreasing the number of the circuit boards 1 during production. Hence the cost of design, production and inventory can be reduced.

Figure 2:
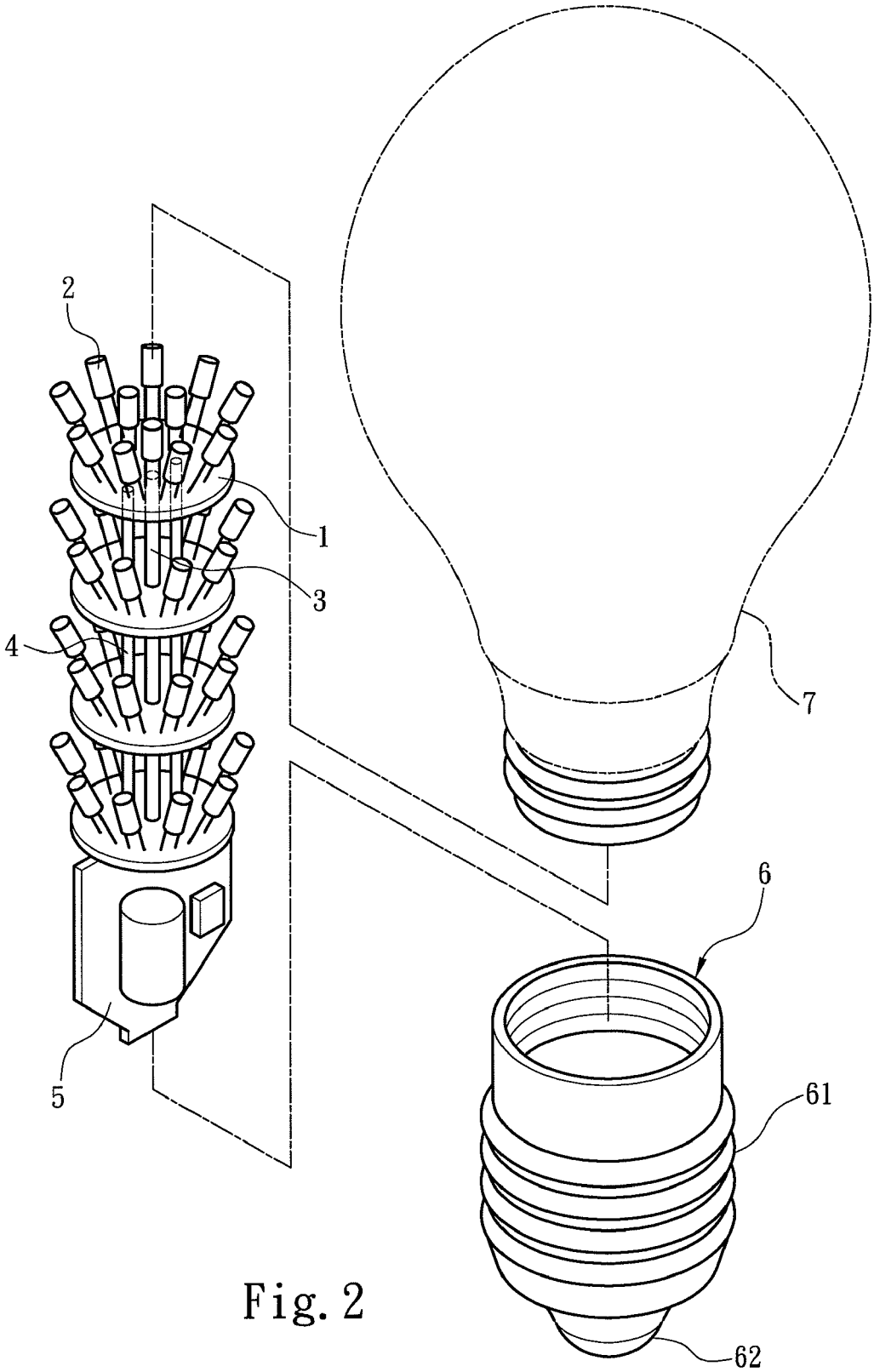
FIG. 2 is an exploded view of the lighting bulb according to the present invention.
Figure 3:
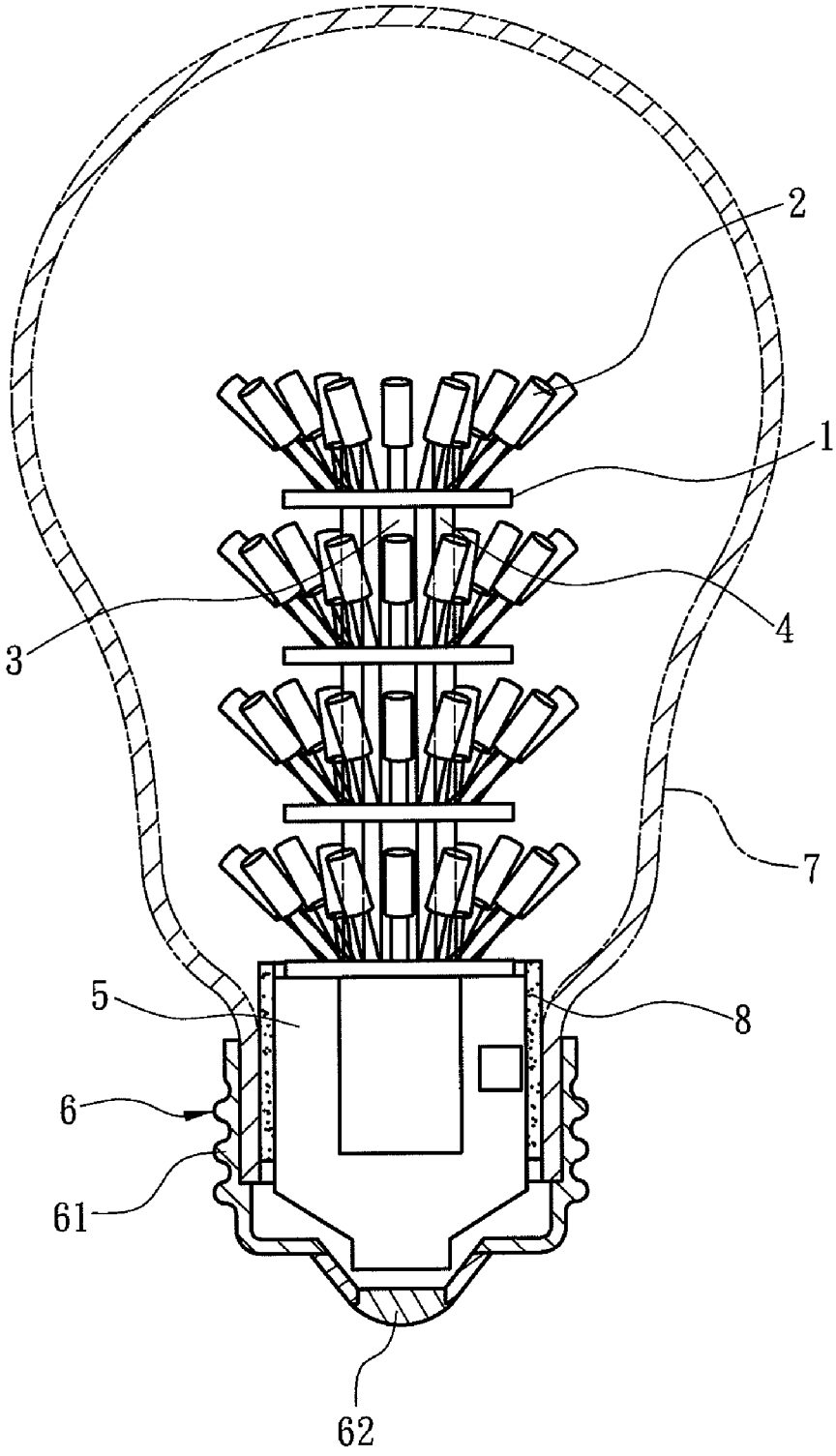
FIG. 3 is a sectional view of the lighting bulb according to the present invention.
Figure 4:
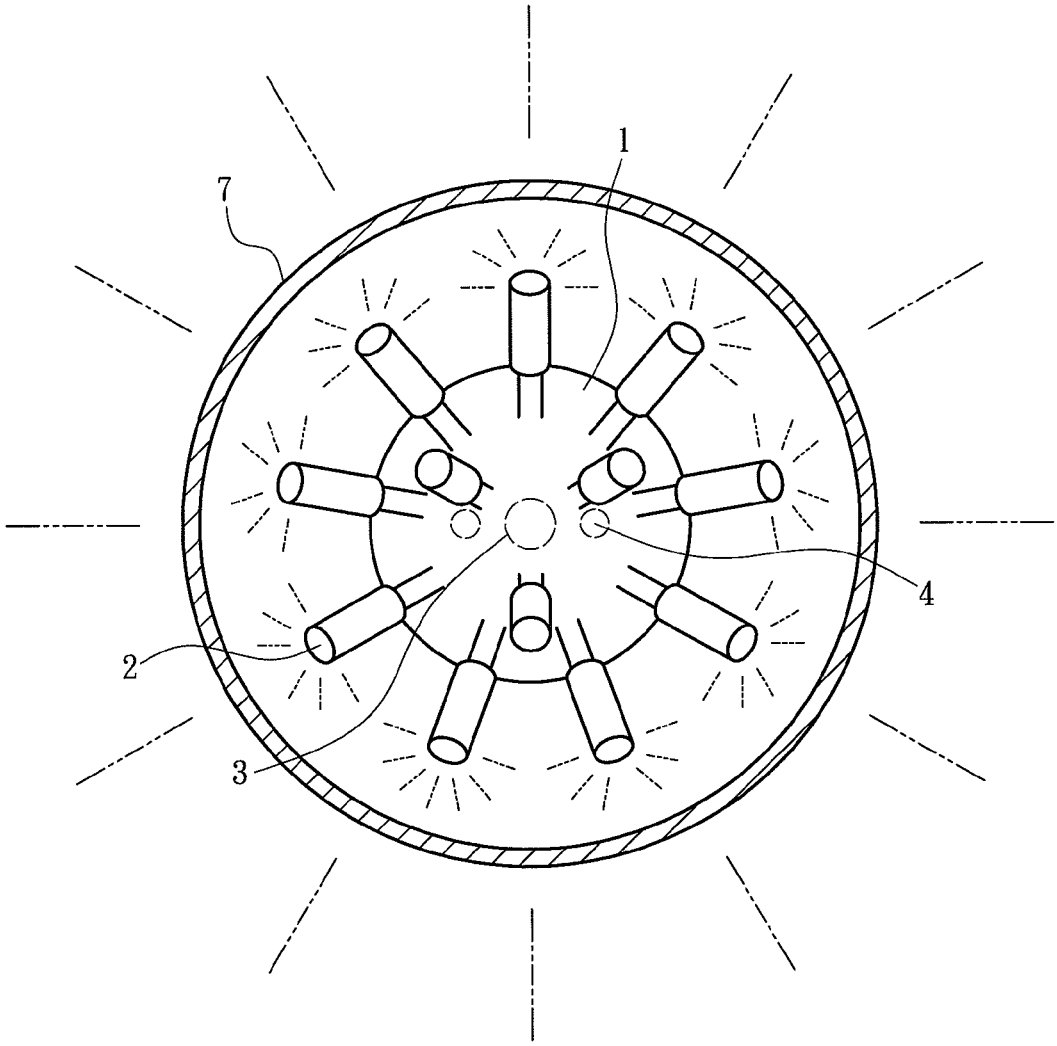
FIG. 4 is a schematic view of the lighting bulb in a use condition.

Referring to FIGS. 2, 3 and 4, the LED lamp set may be coupled with a socket 6 and a lamp shade 7 to form a lighting bulb. To prevent the LED lamp set from skewing during transportation or use, the support post 3 has to be held steadily. This can be accomplished through a number of approaches. One option is fastening the support post 3 on the ignition circuit 5 which is latched in the socket 6 to provide the support needed. Another approach is to have the support post 3 encased by a holder 8 which is integrally formed by injection of plastics so that the encased support post 3 forms a larger base filled with the holder 8 to form a compact and steady support. The holder 8 may also encase the ignition circuit 5 to provide desired insulation to enable the lighting bulb to conform to various standards of safety regulations. The plastic material of the holder 8 may be thermo-conductive plastics to disperse heat of the holder 8. The socket 6 has a plurality of conducting rims 61 and 62 to connect to the ignition circuit 5 to transmit the required input power to the LED lamp set. The lamp shade 7 is coupled with the socket 6 to become a shell to cover the LED lamp set. Through the socket 6, the input power can be conducted to light the LED lamp set. The lighting bulb thus formed is compatible to the commonly used sockets and makes promotion to general household use easier.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An LED lamp set, comprising:

at least one support post;

a plurality of circuit boards spaced from each other in a substantially parallel manner and coupled on the support post in series, each of the circuit boards being linked to a plurality of LEDs which surround the support post; the LEDs including a plurality of light emission surfaces which form a non-vertical inclined angle with the surfaces of the circuit boards;

an ignition circuit receiving an input power and transforming the input power to an ignition power; and at least two conducting wires connecting to the circuit boards in series and including one end linking to the ignition circuit to conduct the ignition power to light the LEDs.

2. The LED lamp set of claim 1, wherein the support post is coupled on the ignition circuit.

3. The LED lamp set of claim 1, wherein the LEDs are tilted away from the center of the circuit boards.

4. The LED lamp set of claim 3, wherein one of the circuit boards is connected to a distal end of the support post and includes at least one LED on the surface thereof among the LEDs surrounding the circuit board.

5. The LED lamp set of claim 1, wherein the support post runs through all the circuit boards.

6. The LED lamp set of claim 1, wherein the support post is encased by a holder.

7. The LED lamp set of claim 6, wherein the holder is integrally formed by injection of plastics to encase the support post.

8. The LED lamp set of claim 7, wherein the plastics is thermo-conductive plastics.

9. The LED lamp set of claim 6, wherein the holder encases the ignition circuit together.

10. A lighting bulb including the LED lamp set of claim 4, comprising:

an LED lamp set;

a socket including a plurality of conducting rims to conduct an input power to the LED lamp set; and a lamp shade coupling with the socket to form a shell to cover the LED lamp set.

11. The lighting bulb of claim 10, wherein the support post is encased by a holder.

12. The lighting bulb of claim 11, wherein the holder is integrally formed by injection of plastics to encase the support post.

13. The lighting bulb of claim 12, wherein the plastics is thermo-conductive plastics.

14. The lighting bulb of claim 11, wherein the holder encases the ignition circuit together.

* * * * *